US011661645B2

(12) United States Patent
Hummelshøj

(10) Patent No.: US 11,661,645 B2
(45) Date of Patent: May 30, 2023

(54) METHOD OF CASE HARDENING A GROUP IV METAL

(71) Applicant: Expanite Technology A/S, Hillerød (DK)

(72) Inventor: Thomas Strabo Hummelshøj, Frederiksberg (DK)

(73) Assignee: EXPANITE TECHNOLOGY A/S, Hillerød (DK)

( * ) Notice: Subject to any disclaimer, the term of this patent is extended or adjusted under 35 U.S.C. 154(b) by 467 days.

(21) Appl. No.: 16/720,877

(22) Filed: Dec. 19, 2019

(65) Prior Publication Data

US 2020/0199725 A1 Jun. 25, 2020

(30) Foreign Application Priority Data

Dec. 20, 2018 (EP) ..... 18214648

(51) Int. Cl.

| | |
|---|---|
| ***C22F 1/18*** | (2006.01) |
| ***C21D 9/00*** | (2006.01) |
| ***C22F 1/02*** | (2006.01) |

(52) U.S. Cl.

CPC ..... *C22F 1/183* (2013.01); *C21D 9/00* (2013.01); *C22F 1/02* (2013.01)

(58) Field of Classification Search

None

See application file for complete search history.

(56) References Cited

FOREIGN PATENT DOCUMENTS

| | | | |
|---|---|---|---|
| EP | 0905271 | A1 | 3/1999 |
| EP | 0931848 | A1 | 7/1999 |
| EP | 1174593 | A2 | 1/2002 |
| JP | S6169956 | A | 4/1986 |
| WO | 2004007788 | A1 | 1/2004 |

OTHER PUBLICATIONS

David, et al.."Etude de la diffusion de l'oxygene dans le titane alpha oxyde entre 700° et 950° C.", Journal of the Less-Common Metals, May 1979, vol. 65, No. 1, pp. 51-69. (Year: 1979).*

David, et al., "Etude de la diffusion de l'oxygene dans le titane alpha oxyde entre 700° et 950° C.", Journal of the Less-Common Metals, May 1979, vol. 65, No. 1, pp. 51-69.

(Continued)

*Primary Examiner* — Anthony M Liang

(74) *Attorney, Agent, or Firm* — Buchanan Ingersoll & Rooney P.C.

(57) ABSTRACT

A method of producing a case hardened workpiece of a Group IV metal including: placing a workpiece of a Group IV metal in a vessel, creating a low pressure environment in the vessel in which the pressure, pvac, is less than or equal to 10-5 bar, providing oxygen to the vessel to create a reactive atmosphere in the vessel, the reactive atmosphere comprising oxygen at a partial pressure, pO2, in the range of 10 5 bar to 0.01 bar, heating the workpiece to a hardening temperature in the range of 650° C. to 800° C. in the reactive atmosphere or before the reactive atmosphere is created, maintaining the workpiece in the reactive atmosphere at the hardening temperature for a reactive period of at least 5 hours, cooling the workpiece from the hardening temperature to ambient temperature in the reactive atmosphere or in an inert atmosphere.

12 Claims, 11 Drawing Sheets

(56) References Cited

OTHER PUBLICATIONS

Mat web: "May 24, 2019 ASM Material Data Sheet Titanium Grade 2 Material Notes", retrieved on May 2019, XP055591710, Retrieved from the Internet: URL:http://asm.matweb.com/search/SpecificMaterial.asp?bassnum=MTU020.
Mat web: "May 24, 2019 ASM Material Data Sheet Titanium Ti-6Al-4V (Grade 5), Annealed Material Notes", retrieved on May 2019, XP05559170, Retrieved from the Internet: URL:http://asm.matweb.com/search/SpecificMaterial.asp?bassnum=MTP641.
Sarma, et al., "Recent Advances in Surface Hardening of Titanium", JOM, Feb. 2011, vol. 63, No. 2, pp. 85-92.
Search Report dated Sep. 26, 2019, by the European Patent Office for Application No. 18214648.0.
Takamura, "Surface Hardening of Titanium by Oxygen", Transactions of the Japan Institute of Metals, 1962, vol. 3, Issue 1, pp. 10-14.

* cited by examiner

20μm 5hours

20μm 5hours 30 hours

49μm/30hours

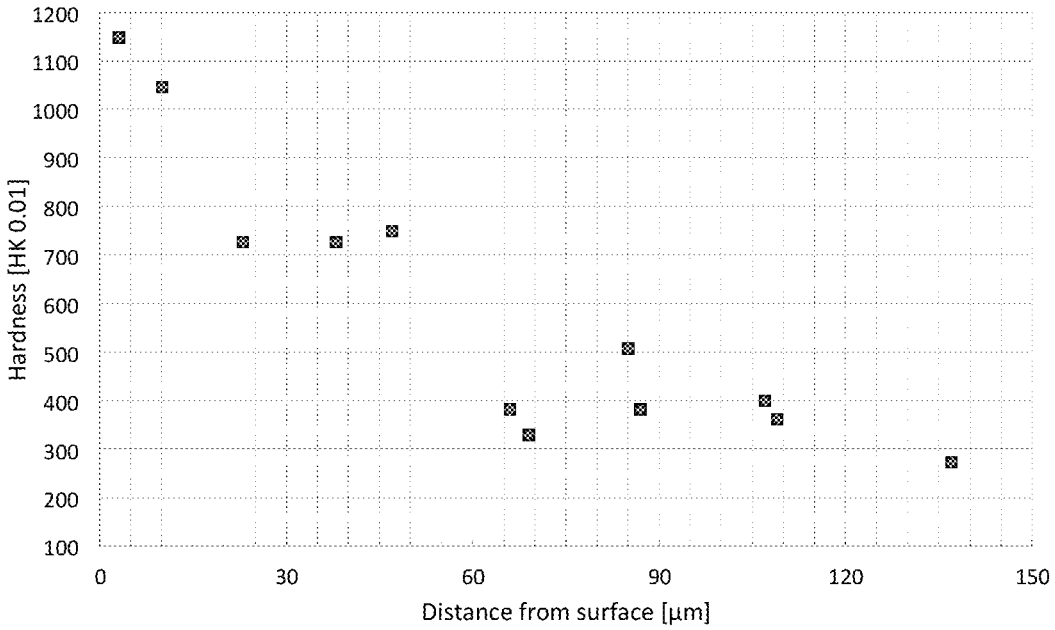
Fig. 7 TiG2 58hours

METHOD OF CASE HARDENING A GROUP IV METAL

FIELD OF THE INVENTION

The present invention relates to a method of producing a case hardened workpiece of a Group IV metal, and to a component of a Group IV metal. The component is obtainable by the method of the invention. The Group IV metal may be titanium. The method and the component of the invention are especially relevant where the visual appearance of the metal is important, e.g. for watches, jewellery, and glasses and where avoidance of galling is important, e.g for implants for the body.

PRIOR ART

Titanium is a light metal with a tensile strength comparable to stainless steel, which naturally reacts with oxygen to form a titanium oxide layer on the surface that provides corrosion resistance. These characteristics make titanium highly attractive in many fields. Titanium is considered biocompatible so that it is relevant for medical uses, e.g. as implants, and moreover the biocompatibility prevents allergic reactions. The light weight and the corrosion resistance combined with the biocompatibility make titanium an interesting metal for use in watches, jewellery, glasses and the like. However, the naturally forming layer of titanium oxide is thin, e.g. in nanometer scale, and titanium is relatively soft, e.g. with a hardness less than about 500 HV. It is therefore desirable to case harden the metal in order to improve the characteristics for decorative and other purposes.

Various non-metallic elements, in particular oxygen and nitrogen, dissolve easily in titanium and the metal can be hardened by dissolving such non-metallic elements. Dissolution of non-metallic elements can lead to formation of solid solutions of the non-metallic elements or the non-metallic elements can form compounds on the surface of the metal. Formation of these compounds will generally provide a treated titanium component with a hard surface, e.g. of 1,000 HV or more. However, compounds of titanium with certain elements, e.g. nitrogen, can be coloured, which may be unwanted for decorative items of titanium, and may also have an unattractive appearance. Furthermore, any additional processing of a case hardened component may not be possible. There is therefore an interest in the field to provide methods to dissolve non-metallic elements in titanium without formation of compounds so that the non-metallic element remains in solid solution. An overview of surface hardening of titanium is provided by B. Sarma and K. S. Ravi Chandran (2011, JOM, 63,2: 85-92).

As an early example JPS6169956 discloses a method to form a thick hardened surface layer of Ti and to enable mirror finishing by polishing. The method comprises a heat treatment at temperature between 800 and 880° C. in an atmosphere of gaseous $N_2$ mixed with 5-500 ppm $O_2$ and 10-5,000 ppm $H_2$ or 50 to 5,000 ppm steam under atmospheric pressure. The method provides a hardened layer of about 100-150 μm thickness for polishing for mirror finishing.

EP 1174593 discloses a hardening method with specific advantages for a poppet valve of titanium or a titanium alloy. The method comprises introducing $O_2$ into a furnace to keep the oxygen density less than the stoichiometrical amount for forming titanium oxides in the furnace; and heating the poppet valve for 1 to 4 hours at temperature of 700 to 840° C. to introduce oxygen atoms into titanium of the valve to form Ti-O interstitial solid solution. Treatment times of 2 to 3 hours are disclosed as preferable and treatment times of more than 4 hours are said to be too long. The method may employ an oxygen density to a whole surface area of the poppet valve of $1.10\times10^{-7}$ g/cm$^2$ to $1.47\times10^{-6}$ g/cm$^2$. The method increases hardness and wear resistance but may not provide an attractive visual appearance. For items such as a poppet valve, the functionality is generally much more important than the appearance.

EP 0905271 discloses a method of surface treating titanium or a titanium alloy. The method comprises a heating process comprising applying an annealing treatment by heating the metal at a reduced pressure, a hardening treatment process in an atmosphere of 100 to 30,000 ppm oxygen in nitrogen at a pressure between 1.33 Pa and atmospheric pressure at 700 to 800° C. and cooling the titanium or titanium alloy to room temperature after the hardening treatment. The method provides a first hard layer where nitrogen and oxygen reside in solid solution without forming compounds and a second hard layer in a region at a depth deeper than the first hard layer up to 20 μm from the surface which contains oxygen in solid solution. The hardened titanium has an average surface roughness Ra is 0.4 μm or less, a hardness at the depth of 1.0 μm from the surface between 820 and 940 HV and a crystal grain size less than 60 μm. When the method was performed at a temperature above 800° C. the desired characteristics were not obtained. No clear differences were evident when the hardening treatment was performed at a reduced total pressure or at atmospheric pressure.

EP 0931848 discloses a method of processing a titanium material. The method comprises a first step of heating a titanium material in an inert gas atmosphere, a heat treatment at a temperature between 700° C. and the alpha to beta transformation point in an atmosphere of nitrogen and oxygen before heating in an inert gas atmosphere to a temperature of at least 700° C. and cooling the material in an inert gas atmosphere. The atmosphere in the first heat treatment can comprise 300 to 20,000 ppm $O_2$ in nitrogen with a total pressure in the range of 0.133 to $1.33\times10^3$ Pa (so that the $O_2$ pressure can be in the range of $4\times10^{-10}$ to $2.66\times10^{-4}$ bar). The method is thought to minimise distortion caused by nitrogen and oxygen in solid solution and formation of compounds, which is avoided, so that a low surface roughness is obtained together with a limited crystal grain size.

WO2004/007788 discloses a method of case hardening an article of titanium or a titanium-based alloy, or of zirconium or a zirconium-based alloy, wherein the article is heat treated at one or more temperatures in the range of 850° C. to 900° C. and at a pressure in the order of atmospheric pressure in an oxygen diffusion atmosphere comprising (a) a carrier gas which does not react chemically with the article in the said temperature range and (b) molecular oxygen, wherein the concentration of oxygen in the oxygen diffusion atmosphere is in the range of 10 volumes per million to 400 volumes per million.

"Surface Hardening of Titanium by Oxygen" by Akira Takamura (Transactions of the Japan Institute of Metals, 1962 Volume 3 Issue 1 Pages 10-13) discloses a method of surface hardening titanium without serious scaling and embrittlement of the base metal. The method involves direct oxidation in dry oxygen followed by diffusion treatment of the oxide film in an inert atmosphere at 850° C. It is disclosed that the amount of oxygen absorbed in the preliminary oxidation has to be in the range of 1 to 2 mg/cm$^2$ to obtain a hardened layer of appreciable depth. In this disclosure, conditions are selected to facilitate the formation of titanium oxides.

The present inventors believe that case hardening of titanium and similar metals can be improved compared to the methods of the prior art, and it is an aim of the present invention to provide an improved method of case hardening a metal of the titanium group as well as a metal case hardened by the method.

DISCLOSURE OF THE INVENTION

In a first aspect the present invention relates to a method of producing a case hardened workpiece of a Group IV metal, the method comprising the steps of:

placing a workpiece of a Group IV metal in a vessel, creating a low pressure environment in the vessel in which the pressure, $p_{vac}$, is less than or equal to $10^{-5}$ bar, providing oxygen to the vessel to create a reactive atmosphere in the vessel, the reactive atmosphere comprising oxygen at a partial pressure, $p_{O2}$, in the range of $10^{-5}$ bar to 0.01 bar, heating the workpiece to a hardening temperature in the range of 650° C. to 800° C. in the reactive atmosphere or before the reactive atmosphere is created, maintaining the workpiece in the reactive atmosphere at the hardening temperature for a reactive period of at least 5 hours, cooling the workpiece from the hardening temperature to ambient temperature in the reactive atmosphere or in an inert atmosphere.

In a second aspect, the present invention relates to a method of producing a hardened workpiece of grade 5 titanium, the method comprising the steps of:

i) case hardening the workpiece in an oxygen-containing environment; and ii) core hardening the workpiece.

In further aspects, the invention relates to components of a Group IV metal.

In one aspect, the component is a component of Grade 5 titanium, the component having a diffusion layer having a thickness in the range of 20 μm to 80 μm from the surface of the component, which diffusion layer at a depth of 5 μm or less has a hardness of at least 900 HV, which diffusion layer at a depth of 20 μm has a hardness of at least 150% of the core hardness of the component, the core hardness of the component being in the range of from 300 to 400 HV at a depth of 100 μm from the surface of the component and which diffusion layer comprises oxygen in solid solution and does not comprise compounds of oxygen and the Grade 5 titanium.

In another aspect, the component is a component of Grade 2 titanium, the component having a diffusion layer having a thickness in the range of 20 μm to 100 μm from the surface of the component, which diffusion layer at a depth of 5 μm or less has a hardness of at least 750 HV, which diffusion layer at a depth of 30 μm has a hardness of at least 400 μm, the core hardness of the component being in the range of from 250 to 350 HV at a depth of 120 μm from the surface, and which diffusion layer comprises oxygen in solid solution and does not comprise compounds of oxygen and the Grade 2 titanium.

The components are obtainable by the method of the invention.

Embodiments of the invention are outlined in the claims and the following description.

Any Group IV metal is appropriate for the invention. In specific embodiments the Group IV metal is selected from the list of titanium, titanium alloys, zirconium or zirconium alloys. ASTM provides a grading system for titanium and titanium alloys. References to, for example, Grade 5 or Grade 2 titanium thus refer to these species according to the ASTM standard.

By creating a low pressure environment in the vessel in which the pressure is less than or equal to $10^{-5}$ bar, it is ensured that the reactive atmosphere that is subsequently created contains only trace amounts of undesirable species such as nitrogen. This is particularly important where the vessel contains air rather than being flushed with an inert species before the low pressure environment is created. The low pressure environment also facilitates dissolution of oxygen when added. A reactive atmosphere containing essentially only oxygen can be created by providing substantially pure oxygen to the vessel once the low pressure environment has been created.

In some embodiments, the vessel is flushed with an inert gas before the low pressure environment is created. The total pressure of the reactive atmosphere is the sum of $p_{vac}$ and $p_{O2}$, and thus the reactive atmosphere contains only the gas present in the low pressure environment and the subsequently added gas, for example substantially pure oxygen. However, it has further been found that when the vessel comprises a carbon source such as a graphite retort, a reaction can occur between the retort and oxygen at the hardening temperature as follows: 2C+O2=2CO.

Thus, carbon is liberated and an atmosphere containing CO and $CO_2$ is provided. As such, where the vessel comprises a graphite retort, the total pressure of the reactive atmosphere is the sum of $p_{vac}$, $p_{O2}$, $p_{CO}$ and $PC_{O2}$. This in turn facilitates the introduction of carbon into the Group IV metal. Thus, a solid solution of both oxygen and carbon can be achieved. The presence of both oxygen and carbon brings a smooth hardness transition to the core, which can be beneficial for loadbearing capacity and fatigue properties.

It is noted that carbon-containing species can be avoided by avoiding carbon sources, such as by using an alternative retort, for example a metallic retort. When a Group IV metal is treated in the method of the invention the surface of the Group IV metal obtains a diffusion layer having a content of oxygen in solid solution. The diffusion layer is free of compounds of elements such as oxygen, nitrogen and carbon with the Group IV metal, e.g. oxide compounds and nitride compounds, and moreover due to the negligible amount of nitrogen present during treatment, the diffusion layer contains only an insignificant amount of nitrogen in solid solution, e.g. less than 2% (w/w) at a depth of 1 μm, or less than 1% (w/w). In particular, the nitrogen content of the case hardened Group IV metal will typically be on level with the content of nitrogen present as an unavoidable impurity. Thus, the component of the invention does not comprise compounds of nitrogen and the Group IV metal or carbon and the Group IV metal.

Preferably, the workpiece of a Group IV metal that is placed in the vessel is substantially free of oxide and/or nitride compounds.

The partial pressure of nitrogen in the reactive atmosphere may be in the range of 0 bar to $10^{-5}$ bar.

The partial pressure of carbon-containing species may be in the range of 0 bar to $10^{-5}$ bar. Where there is no carbon source, such as a graphite retort, the reactive atmosphere comprises predominantly oxygen, with any other species being present only in trace amounts, namely partial pressures less than the partial pressure of oxygen, and particularly less than $10^{-5}$ bar.

Preferably $P_{O2}>P_{vac}$. This is particularly beneficial when the vessel contains air before the low pressure environment is created as it ensures that the nitrogen content of the vessel is negligible, even when the partial pressure of oxygen is $10^{-5}$ bar.

The present inventors have now surprisingly found that when a Group IV metal, e.g. titanium or a titanium alloy, is treated according to the present invention, a high level of oxygen can be dissolved in the Group IV metal and further remains in solid solution without forming compounds between oxygen and the Group IV metal.

Without being bound by theory the present inventors believe that nitrogen in solid solution, as observed in EP 0905271 and EP 0931848, can promote formation of compounds between oxygen and the Group IV metal and further that nitrogen in solid solution will also establish a hindrance for diffusion of oxygen into the Group IV metal. Therefore, the concentration of oxygen employed in the treatment atmosphere of the prior art is limited to a level where no compounds of oxygen or nitrogen are formed in the titanium which in turn also limits the amount of oxygen that can effectively be introduced into the titanium. In contrast, the present method allows dissolution of much higher amounts of oxygen without formation of compounds between oxygen and the Group IV metal, which is reflected in a higher hardness at a greater depth than seen for the prior art. For example, in some embodiments the component of the invention at a depth of 20 μm, as measured from the surface of the component, has a hardness of at least 150% of the core hardness of the component.

In the method of the invention the nitrogen pressure is so low that nitrogen does not diffuse into the Group IV metal in any significant amount so that oxygen more easily can be diffused into the Group IV metal without forming compounds between oxygen and the Group IV metal. This in turn allows that a diffusion layer is provided where oxygen is present in solid solution at a higher amount and to a greater depth without formation of oxide compounds, e.g. titanium oxides, than afforded by the methods of the prior art, e.g. as represented by EP 0905271. The diffusion layer may be defined in terms of the content of oxygen in solid solution. Thus, the diffusion layer may have a content of oxygen in solid solution above 0.5% at the depth of 20 μm and up to the thickness of the diffusion layer. The diffusion layer is free of oxide compounds, and also does not contain nitride compounds.

Further, contrary to the indications in the prior art, the inventors have surprisingly found that favourable results can be obtained at the hardening temperatures and reactive periods of the present invention. In particular, the combination of a relatively narrow range of treatment temperatures, namely from 650° C. to 800° C., preferably 700° C. to 750° C., in combination with treatment times of 5 hours or more results in a process which avoids distortion of the Group IV metal by high-temperature stress relaxation, but which provides desirable hardness characteristics. Further, these conditions allow the workpiece to be provided with a mirror polish, thereby making the piece suitable for applications such as jewellery and watches where appearance is very important.

The diffusion layer is easily discernible when a cross-section of the treated Group IV metal is observed visually, e.g. using an optical microscope, or using an electron microscope, and the thickness of the diffusion layer can thus be measured by observation of the cross-section. The diffusion layer obtained in the method of the invention has a thickness of at least 20 μm. For example, the component of the invention the diffusion layer has a thickness in the range of 20 μm to 80 μm, preferably in the range of 20 μm to 60 λm, as determined visually for Grade 5 titanium. In particular, the interface between the diffusion layer and the core of the Group IV metal is visible in the cross-section of the Group IV metal, where the core of the Group IV metal may be represented by crystals, e.g. α and/or β crystals, and the diffusion layer is represented by a more uniform appearance where the interface between the diffusion layer and the core may be visible as a dark line. Thus, the thickness of the diffusion layer can be recorded from the surface of the Group IV metal to the interface between the diffusion layer and the core as determined by visual observation.

For Grade 2 titanium, the diffusion layer may have a thickness in the range of 20 μm to 100 μm, or the thickness may be the same as for Grade 5 titanium.

Furthermore, for the Group IV metals, the diffusion layer can also be discerned by measuring the hardness in the cross-section. The hardness measured in the cross-section may also be referred to as the "microhardness". For example, untreated titanium typically has a hardness in the range of 250 HV to 300 HV and untreated Ti-6Al-4V typically has a hardness in the range of 300 HV to 350 HV so that the core hardness of treated titanium will typically be in the range of 250 HV to 300 HV and the core hardness of treated Ti-6Al-4V will typically be in the range of 300 HV to 350 HV. The core hardness of zirconium will typically be in the range of 200 HV to 250 HV.

The diffusion layer obtained according to the invention may have, at a depth of 20 μm, a hardness, e.g. microhardness, of at least 150% of the core hardness of the treated workpiece or component. Correspondingly, a titanium component of the invention will at least have a hardness in the range of 375 HV to 450 HV at a depth of 20 μm although for a specific sample the core hardness should be measured and compared to the hardness at the depth of 20 μm. In a further embodiment the diffusion layer has a hardness at a depth of 60 μm of at least 125% of the core hardness of the treated workpiece or component. In yet another embodiment the diffusion layer has a hardness at a depth of 40 μm of at least 125% of the core hardness of the treated workpiece or component. In a particular embodiment of the component, the depth where the hardness is 125% of the core hardness is considered to represent the thickness of the diffusion layer. Thus, in an embodiment of the invention the thickness of the diffusion layer is recorded by finding the distance from the surface of the case hardened component of a Group IV metal where the hardness is 125% of the core hardness of the Group IV metal. In an embodiment of the invention, this distance is up to 80 μm from the surface of the Group IV metal. In any case the hardness at a depth of 20 μm will be at least 150% of the core hardness. In an embodiment the cross-sectional hardness of the diffusion layer is at least 400 HV at a depth of 80 μm, e.g. for a component of titanium, such as grade 2 titanium, or a titanium alloy, such as grade 5 titanium, or of zirconium.

Regardless of the thickness of the diffusion layer in specific embodiments, e.g. embodiments of the component, such as a component of titanium, such as grade 2 titanium, or a titanium alloy, such as grade 5 titanium, or as obtained in embodiments of the method of the invention, the hardness at a depth of 5 μm is generally at least 800 HV. For Grade 5 titanium, the hardness at a depth of 5 μm may be at least 900 HV or 1000 HV and for Grade 2 titanium, the hardness at a depth of 5 μm is at least 900 HV or 1000 HV. Likewise, the hardness at a depth of 10 μm may be at least 900 HV or 1000 HV.

The method of the invention employs a reactive atmosphere and may also employ an inert atmosphere. The reactive atmosphere comprises oxygen at a partial pressure in the range of $10^{-5}$ bar to 0.01 bar, such as in the range of $10^{-4}$ bar to 0.01 bar, or $10^{-3}$ bar to 0.01 bar. Oxygen is provided to the Group IV metal so that the partial pressure of the oxygen is at least $10^{-5}$ bar in order to provide sufficient oxygen to the Group IV metal. At partial pressures above 0.01 bar the activity of oxygen will be too high, which leads to formation of oxide compounds with the Group IV metal. In the inert atmosphere there is no lower limit for the contents of oxygen containing gaseous species, and their partial pressures may be 0. In the context of the invention the inert atmosphere thus generally has a content of an oxygen containing gaseous species at a partial pressure in the range of 0 bar to less than $10^{-5}$ bar in order for the inert atmosphere also to be inert with respect to oxygen. However, the steps of heating and cooling the workpiece in the method of the invention may be performed in the reactive atmosphere or in an inert atmosphere as desired. In general, when the workpiece is heated and cooled in an inert atmosphere the actual treatment with oxygen at the hardening temperature can be controlled more accurately than when the workpiece is heated or cooled in the reactive atmosphere, but no adverse effects are observed when the workpiece is heated or cooled in the reactive atmosphere. The inert atmosphere has the same upper limit for the partial pressure of the nitrogen and carbon containing gaseous species as the reactive atmosphere.

Both the inert atmosphere and the reactive atmosphere are limited with respect to the contents of nitrogen containing species, e.g. $N_2$, and alkanes and alkenes, and for both the inert atmosphere and the reactive atmosphere the partial pressure of any nitrogen containing gaseous species may be up to $10^{-5}$ bar, e.g. $5\times10^{-6}$ bar or less, and the partial pressure of any carbon containing gaseous species may be up to $10^{-5}$ bar, e.g. up to $10^{-6}$ bar. Partial pressures of nitrogen containing gaseous species and carbon containing species above the indicated ranges are not considered inert in the context of the invention. When the partial pressures of nitrogen and carbon containing species are within these limits dissolution of the respective elements is limited to prevent adverse effects from the elements. In particular, the present inventors have surprisingly found that oxygen diffuses more easily into the Group IV metal under the conditions of the present invention. Thereby oxygen can be diffused to a higher amount at a larger depth without formation of oxide compounds with the Group IV metal, which in turn provides that the diffusion layer is formed without discernible layers in the diffusion layer; the diffusion layer may also be described as "homogeneous". In embodiments of the invention the inert atmosphere and/or the reactive atmosphere do not contain nitrogen containing species and/or carbon containing species.

Preferably, oxygen is supplied in a substantially pure form. It will be understood that substantially pure means that the oxygen has a purity of, for example, 98% or greater, preferably 99% or greater. However, the presence of trace amounts of impurities is not excluded by the term "substantially pure".

According to the present invention, in the absence of a carbon source, the total pressure ($P_{tot}$) in the reactive atmosphere can be considered to be the sum of the partial pressure of oxygen ($P_{O2}$) and the starting pressure i.e. the pressure of the low pressure environment ($P_{vac}$):i.e. $P_{tot}=P_{vac}+P_{O2}$ In the presence of a carbon source, such as a graphite retort, the total pressure ($P_{tot}$) in the reactive atmosphere can be considered to be the sum of the partial pressure of oxygen ($P_{O2}$), the starting pressure i.e. the pressure of the low pressure environment ($P_{vac}$ the partial pressure of CO ($P_{co}$) and the partial pressure of CO2 ($P_{CO2}$): i.e. $P_{tot}=P_{vac}+P_{O2}+p_{CO}+p_{CO2}$.

The partial pressures of gaseous species in the inert atmosphere and the reactive atmosphere may be adjusted freely using any technology as long as the partial pressures are within the indicated ranges.

Dissolution of elements such as oxygen into Group IV metals can occur at temperatures of about 600° C. or higher. However, in order to achieve the effects of the method of the invention the hardening temperature is higher than 600° C. i.e. at least 650° C. The upper limit of the hardening temperature is chosen to avoid distortion of the Group IV metal, particularly distortion caused by stress relaxation. Thus, whilst a higher temperature is generally desirable to facilitate diffusion, a relatively low upper limit has been selected to prevent distortion. It will be understood that temperature is also relevant for kinetics of the process and a lower temperature will result in slower surface kinetics. The temperature range of the present invention provides a balance of the many temperature-controlled processes occurring. Preferably the hardening temperature is in the range of 700° C. to 750° C.

The duration of the reactive period can be chosen freely to obtain the desired characteristics of the workpiece. In general, dissolution of oxygen will start immediately, and after a reactive period of about 5 hours a visible diffusion layer has been formed, which can also be determined by measuring the surface hardness of the treated Group IV metal. In general, the higher the hardening temperature the faster the dissolution reaction takes place. The reactive period may be from 5 hours to 75 hours, or 5 hours to 50 hours, or 5 hours to 30 hours. Any suitable vessel may be used. Preferably the vessel is a vacuum furnace.

In some embodiments the vessel comprises a graphite retort. In other embodiments, the vessel comprises a non-graphite retort, such as a metallic retort. When a graphite retort is used, the total pressure of the reactive atmosphere is the sum of $p_{vac}$, $p_{O2}$, $p_{CO}$ and $p_{CO2}$.

It will be understood that a low pressure environment in the vessel is an environment in which the pressure is less than around $10^{-5}$ bar, for example in the range $10^{-6}$ to $10^{-5}$ bar or $5\times10^{-6}$ to $10^{-5}$ bar.

The desired partial pressure of oxygen may be maintained during the reactive period in any suitable way. In some embodiments, oxygen is supplied for the total duration of the reactive period. The oxygen flow rate is selected to provide the desired amount of oxygen, whilst avoiding oxygen levels that are too high. Oxygen levels that are too high are typically those in which the partial pressure of oxygen is higher than 0.01 bar. It will be understood that high oxygen levels are undesirable as they promote the formation of unwanted metal oxide compounds.

Where oxygen is supplied for the total duration of the reactive period, the flow rate may be constant or may be varied during the reactive period. Any suitable flow rate may be used, and the flow rate may be selected based on the volume of the vessel and/or the total surface area of the workpiece(s) contained within the vessel. In some embodiments a flow rate in the range of 0.5 ml/min to 10 ml/min is suitable. A flow rate in the range of 0.5 ml/min to 3 ml/min may be preferred.

Alternatively, the reactive period may comprise at least one supply period and at least one non-supply period. A supply period is a period during which oxygen is supplied to the vessel. A non-supply period is a period during which no additional oxygen is supplied to the vessel. Thus, during the non-supply period, the vessel is effectively a sealed chamber to which nothing is added.

When the duration of the reactive period exceeds the combined duration of a supply period and a non-supply period, more than one supply and/or non-supply period will be required.

When the reactive period comprises supply and non-supply periods, the oxygen supply will be halted for a period of time to prevent oxygen levels within the vessel getting too high i.e. to prevent the partial pressure of oxygen exceeding 0.01 bar.

The supply periods and non-supply periods may be of equal length or may be of different durations. The duration of the supply period(s) and the non-supply period(s) may be pre-determined or may be based on measurements of oxygen levels made during the process.

A reactive period may comprise one supply period followed by one non-supply period or it may comprise two or more cycles of supply period followed by non-supply period. Each cycle may be the same, or subsequent cycles may have different durations of supply and/or non-supply periods compared with the first cycle.

In some embodiments, each supply period is in the range of 1 to 10 minutes and each non-supply period is in the range of 1 minute to 3 hours. For example, each supply period may be 5 minutes and each non-supply period may be 2 hours. The reactive period may be in the range of 5 hours to 30 hours.

In particular embodiments, each supply period is in the range of 1 to 3 hours and each non-supply period is in the range of 1 to 3 hours. Preferably, the supply period is two hours and the non-supply period is two hours. The reactive period may be 5 hours. Alternatively, the reactive period may be in the range of 5 hours to 30 hours.

Where the duration of the reactive period does not permit completion of a whole number of cycles of supply and non-supply periods, the process can simply be terminated part way through a cycle. So, for example, where the supply and non-supply periods are each 2 hours and the reactive period is 5 hours, there will be a supply period of 2 hours followed by a non-supply period of 2 hours, followed by a partial supply period of 1 hour.

Preferably the flow rate of oxygen is constant during a supply period, although it may be varied. In all embodiments, a mass flow controller may be used to control the flow of oxygen.

Regardless of the manner in which the oxygen is supplied, the conditions are selected so that the partial pressure of oxygen is such that metal-oxide formation is avoided. This is achieved by partial pressures of oxygen less than 0.01 bar.

The reactive period may have a duration in the range of 5 hours to 75 hours, or 5 hours to 50 hours. Preferably, the reactive period is in the range of 5 hours to 30 hours. The duration of the reactive period may be selected based on the Group IV metal selected for the workpiece and/or the total surface area of the workpiece(s) in the vessel. The thickness of the diffusion layer is generally proportional to the duration of the reactive period, and when the duration is in the range of 5 hours to 30 hours a thickness of the diffusion layer in the range of at least 20 μm to 60 μm can be obtained, in particular when the hardening temperature is in the range of 650° to 800° C., preferably 700° C. to 750° C.

The method may further comprise the step of polishing the workpiece after the step of cooling the workpiece. Polishing the workpiece can result in a mirror finish, which is particularly desirable for jewellery applications. The method of the present invention results in a product which is particularly suitable for polishing.

For some applications, such as implants, the core hardness of the component can be important, in addition to the surface hardness. Thus, in a second aspect, the present invention relates to a method of producing a hardened workpiece of grade 5 titanium comprising the steps of:

i) case hardening the workpiece in an oxygen-containing environment; and ii) core hardening the workpiece.

Thus, a component with desirable core and surface properties can be achieved.

Forms of core hardening are known to the skilled person and this may be conducted in any suitable way.

In some embodiments, step i) comprises the method according to the first aspect of the invention; and/or step ii) comprises:

a) heating the workpiece to a temperature in the range of 850° C. to 1000° C. and holding the workpiece in this range for a first period of time, b) quenching the workpiece to room temperature, c) heating the workpiece to a temperature in the range of 450° C. to 600° C. and holding the workpiece in this range for a second period of time, and d) cooling the workpiece to room temperature.

The core hardening step may be conducted under a vacuum.

Preferably, in the first heating step, the workpiece will be heated to a temperature around 900° C. and in the second heating step the workpiece will be heated to a temperature of around 500° C.

The first period of time may be from 30 minutes to two hours, for example around 1 hour and the second period of time may be from one hour to three hours, for example two hours. Typically, the second period of time will have a longer duration than the first.

The case hardening should be conducted before the core hardening, since the case hardening temperature is too high compared to the ageing temperature at 500° C. It was previously expected that conducting the core hardening after case hardening would be undesirable as it was expected to negatively impact on the case hardened sample. The inventors have surprisingly found that whilst the temperature changes of the core hardening step can affect the surface hardness profile, the change is generally a beneficial one and thus the core hardening step can result in improved case hardness in addition to a hardened surface.

In another aspect the invention relates to a component, e.g. a polishable component, of a Group IV metal, which is obtainable in the method according to the invention. In particular, in some embodiments the component has a diffusion layer with a thickness in the range of 20 μm to 80 μm, and the thickness may especially be controlled via the duration of the reactive period.

The component may be a component of Grade 5 titanium, the component having a diffusion layer having a thickness in the range of 20 μm to 80 μm from the surface of the component, which diffusion layer at a depth of 5 μm has a hardness of at least 1000 HV, which diffusion layer at a depth of 20 μm has a hardness of at least 150% of the core hardness of the component, the core hardness of the component being in the range of from 300 to 400 HV at a depth of 100 μm from the surface of the component and which diffusion layer comprises oxygen in solid solution and does not comprise compounds of oxygen and the Grade 5 titanium.

The component may have a diffusion layer having a thickness in the range of 20 μm to 60 μm from the surface of the component.

The diffusion layer at a depth of 5 μm may have a hardness of at least 1000 HV.

The diffusion layer at a depth of 2 μm may have a hardness of at least 900 HV or 1000 HV.

The diffusion layer at a depth of 10 μm may have a hardness of at least 900 HV or at least 1000 HV.

The core hardness may be present at 80 μm from the surface, or at 60 μm from the surface.

The component may be a component of Grade 2 titanium, the component having a diffusion layer having a thickness in the range of 20 μm to 100 μm from the surface of the component, which diffusion layer at a depth of 5 μm has a hardness of at least 900 HV, which diffusion layer at a depth of 30 μm has a hardness of at least 700 μm, the core hardness of the component being in the range of from 250 to 350 HV at a depth of 120 μm from the surface, and which diffusion layer comprises oxygen in solid solution and does not comprise compounds of oxygen and the Grade 2 titanium.

The diffusion layer at a depth of 5 μm may have a hardness of at least 1100 HV.

The diffusion layer at a depth of 10 μm may have a hardness of at least 1000 HV.

The diffusion layer at a depth of 40 μm may have a hardness of at least 700 μm.

The surface hardness of the treated workpiece will generally also depend on the duration of the reactive period. For example, treatment in the reactive atmosphere at the hardening temperature for about 5 hours will provide a surface hardness of about 1000 HV, and the surface hardness will generally increase with the duration of the reactive period. For Grade 5 titanium, a maximum is typically reached after around 30 hours (the maximum surface hardness is generally up to 1200 HV for titanium and titanium alloys).

The present inventors have surprisingly found that when a Group IV metal is treated by the method of the invention to provide a diffusion layer with a thickness in the range of 20 μm to 100 μm the Group IV metal can easily be polished to provide a mirror finish despite the possible presence of large crystal grains or roughness in the surface caused by the hardening. The present invention avoids the formation of hard and brittle compounds, thus making the metals polishable. Further, the methods of the present invention reduce the tendency for precipitation to occur at grain boundaries. Reduced grain boundary precipitation is beneficial as this reduces the appearance of grains, thereby improving the ability to achieve a mirror polish in which grains/grain boundaries cannot be seen. Thereby a more robust process is provided since variations occurring due to minor variations in oxygen pressure or other processing parameters are of limited concern. When the diffusion layer has a thickness above 100 μm, e.g. at 120 μm or more, the treated Group IV metal is not polishable, e.g. without using harsh methods that will inevitably prevent formation of mirror finish. This is due to the development of compounds for long process times/thick layers. Likewise, when the diffusion layer has a thickness below 10 μm, e.g. at 5 μm or below, polishing of the Group IV metal will remove the diffusion layer making the hardening treatment obsolete. In contrast, when a Group IV metal is treated to have a diffusion layer with a thickness in the range of 20 μm to 100 μm the Group IV metal can be polished to provide a mirror finish while retaining a surface hardness of 900 HV or more, which is sufficient for providing scratch resistance for components for watches, jewellery, glasses and the like where visual appearance are important. In a specific embodiment the component is a design object or is a part of a design object. The design object may be selected from the group consisting of watches, jewellery, and glasses. The component of the invention may thus also be referred to as a polishable component. In the context of the invention the term "polishable component" means that the treated component can be easily polished using standard methods known in the field. In a specific embodiment of the component of the invention the crystal grain size is above 60 μm. In an embodiment the method of the invention comprises the step of polishing the workpiece after the step of cooling the workpiece from the hardening temperature to ambient temperature. The polishing procedure may be chosen freely. The component of the invention is not limited to components of or for watches, jewellery, glasses and the like, and the component may be a component of any field where a hardened component of a light metal, such as titanium or zirconium, is relevant.

In a specific embodiment the Group IV metal is, subsequent to the hardening treatment of the invention, subjected to a core hardening. Core hardening is well known to the skilled person.

The method of the invention is not limited with respect to the size of the workpiece to be treated, and likewise the component of the invention is not limited with respect to size. However, in a specific embodiment the component has a thickness in the range of 0.1 mm to 20 mm.

Multiple workpieces of a Group IV metal may be treated simultaneously according to the method of the invention. In some embodiments, the combined total surface area of the workpieces in the vessel is in the range of from 0.5 $m^2$ to 5 $m^2$.

BRIEF DESCRIPTION OF THE FIGURES

In the following the invention will be explained in greater detail with the aid of examples and with reference to the figures, in which:

FIG. 7 shows a hardness profile in a cross-section of titanium Grade 2 case hardened according to the invention;

FIGS. 10A, 1013 and 10C show cross-sections of titanium Grade 2 case hardened according to the invention such that there is an oxygen-carbon double layer.

Figure 1:
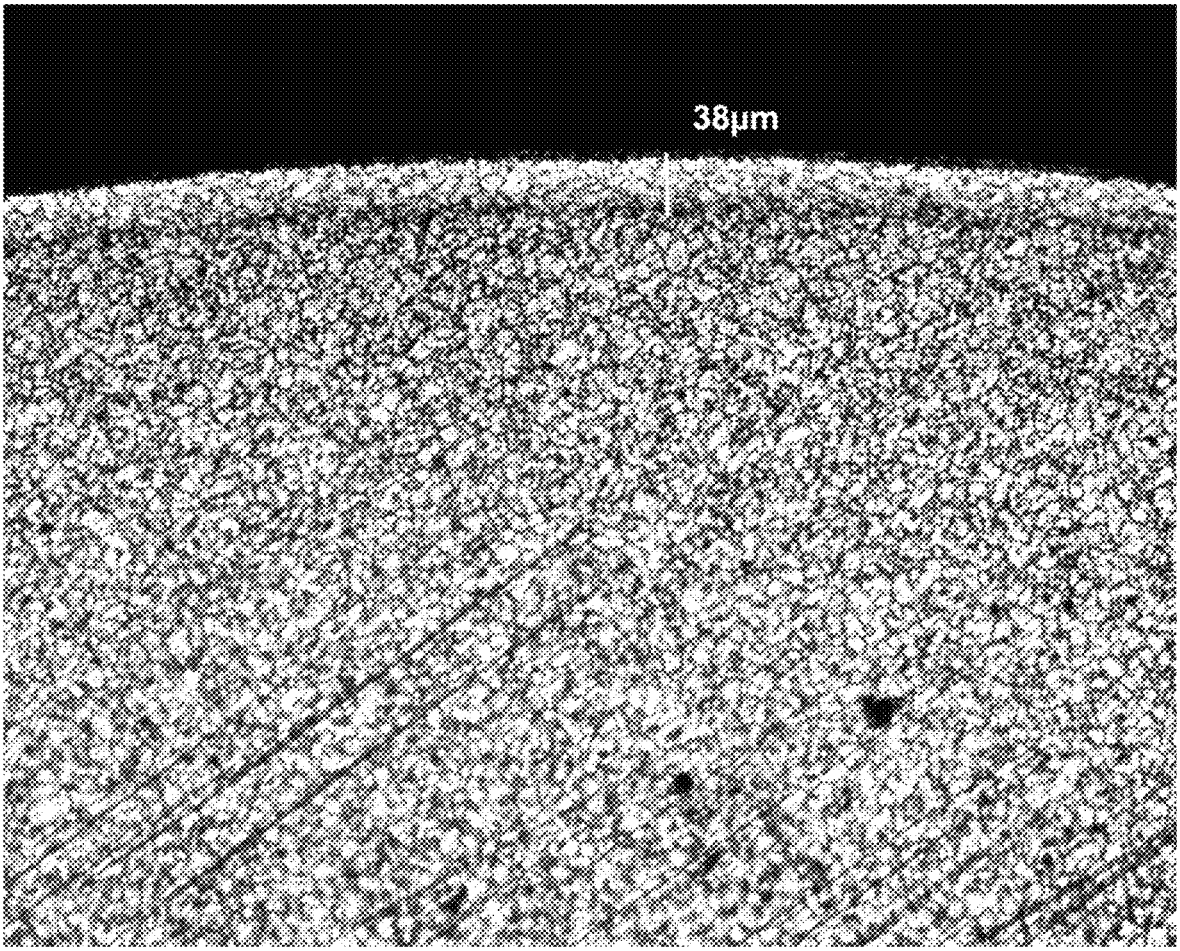
FIG. 1 shows a cross-section of titanium Grade 5 case hardened according to a first embodiment of the invention.

It should be understood that combinations of the features in the various embodiments are also contemplated, and that the various features, details and embodiments may be combined into other embodiments. In particular, it is contemplated that all definitions, features, details, and embodiments regarding the method of the invention are also relevant for embodiments of the component of the invention which are not explicitly described and vice versa.

Reference to the figures serves to explain the invention and should not be construed as limiting the features to the specific embodiments as depicted.

DETAILED DESCRIPTION OF THE INVENTION

The present invention relates to a method of producing a case hardened workpiece of a Group IV metal, and in other aspects the invention relates to components of a Group IV metal, which are obtainable by the method of the invention. Thus, it will be understood that the methods claimed in the present application give rise to the products claimed in the present application. The products are obtainable by the methods.

In the context of the invention "Group IV metal" is any metal selected from the titanium group of the periodic table of the elements or an alloy comprising at least 50% of metals from the titanium group. Thus, a "titanium alloy" is any alloy containing at least 50% (a/a) titanium, and likewise a "zirconium alloy" is any alloy containing at least 50% (a/a) zirconium. It is contemplated that for the method of the invention and for the component of the invention, any alloy containing a sum of titanium and zirconium of at least 50% (a/a) is appropriate. Likewise, the alloy may also comprise hafnium, which is a member of Group IV of the periodic table of the elements so that any alloy having a sum of titanium, zirconium, and hafnium of at least 50% (a/a) is appropriate for the invention.

Unless otherwise noted a percentage in relation to a metal or a component is by weight of the total weight of material, e.g. denoted % (w/w). Likewise, unless otherwise noted a composition of a mixture of gasses is on an atomic basis and may be provided as a percentage or in ppm (parts per million).

In an embodiment of the invention the Group IV metal is titanium or a titanium alloy. Any grade of titanium containing at least about 99% (w/w) titanium is, in the context of the invention, considered to be "pure titanium"; thus, the pure titanium may contain up to about 1% (w/w) trace elements, e.g. oxygen, carbon, nitrogen or other metals, such as iron. Likewise, any grade of zirconium containing at least about 99% (w/w) zirconium is, in the context of the invention, considered to be "pure zirconium". In another embodiment the Group IV metal is the titanium alloy referred to as Ti-6Al-4V, which contains about 6% (w/w) aluminium, about 4% (w/w) vanadium, trace elements and titanium to balance. In particular, nitrogen and carbon contained in a Group IV metal in the context of the invention may represent unavoidable impurities. Elements present as "unavoidable impurities" are considered not to provide an effect for a workpiece treated according to the method of the invention or for the component of the invention.

The alloys of relevance may contain any other appropriate elements, and in the context of the invention an "alloying element" may refer to a metallic component or element in the alloy, or any constituent in the alloy. Titanium and zirconium alloys are well-known to the skilled person.

In the context of the invention the hardness is generally the HV0.05 as measured according to the DIN EN ISO 6507 standard. If not otherwise mentioned, the unit "HV" thus refers to this standard. The hardness is preferably recorded for a cross-section, e.g. of a treated Group IV metal, and it may be noted with respect to the depth of the measurement. In the context of the invention the "depth" is the distance from the surface. When the hardness is recorded at a cross-section the measurement is considered to represent a homogeneous sample with respect to the direction of the pressure applied. In contrast, when the hardness is obtained from measurements at the surface, the measurement may represent an average of several different values of hardness, i.e. at different depths. In the context of the invention a hardness measurement recorded in a cross-section at a depth of about 1 μm is considered to provide the actual hardness of the surface of the material. As an effect of the fact that oxygen is dissolved from the surface, the content of dissolved oxygen will decrease from the surface towards the core of the Group IV metal, and likewise, the hardness will be maximal at the surface, e.g. as represented by measuring the hardness in a cross-section at a depth of about 1 μm. In oxygen hardening methods of the prior art, surface hardnesses of more than 1000 HV are obtained, but the value of the hardness at the surface, e.g. as represented by a hardness measurement in a cross-section at a depth of about 1 μm, provides no information about the hardness at deeper depths.

In an embodiment of the invention the hardness at a depth of 5 μm is at least 800 HV. For example, for components of the invention of titanium or titanium alloys the hardness in a cross-section at a depth of about 5 μm may be at least 900 HV, and for components of the invention of zirconium or zirconium alloys the hardness in a cross-section at a depth of about 5 μm may be at least 700 HV.

In certain aspects, the present invention relates to component treated in the method of the invention. In the context of the invention a "component" can be any workpiece, which has been treated in the method of the invention, and the component can be an individual object, or the component can be a distinct part or element of a whole. The component of the present invention may inter alia be determined in terms of its thickness. In the context of the invention the term "thickness" is generally understood as the smallest dimension of the three dimensions so that as long as an object has a dimension in the range of from 0.1 mm to 5 mm it can be said to have a thickness in the range of from 0.1 mm to 5 mm. The component of the invention may have a thickness of up to 20 mm, e.g. up to 10 mm, such as in the range of 0.1 mm to 5 mm. The component need not consist of the Group IV metal and in an embodiment of the invention the component has an outer surface of the Group IV metal and a core of another material, e.g. another metal, a polymer, a ceramic material etc.

EXAMPLES

Example 1

Steady $O_2$ Supply

Samples of Titanium Grade 5 (also known as Ti-6Al-4V) were treated for 15 hours at 750° C. in a reactive atmosphere of commercially available oxygen.

The samples were first heated from ambient temperature up to 750° C. in vacuum conditions ($10^{-2}$ mbar). When reaching 750° C., oxygen was introduced by a controlled steady flow of 1 ml/min and the samples were retained at 750° C. for 15 hours before cooling to ambient temperature in vacuum conditions ($10^{-2}$ mbar).

The treated samples were cut to reveal the cross-sections, which are presented as the photomicrograph in FIG. 1. FIG. 1 shows the interface between the diffusion layer and the core of the Grade 5 titanium as a dark horizontal line. The thickness of the layer is recorded at about 38 μm.

Figure 2:
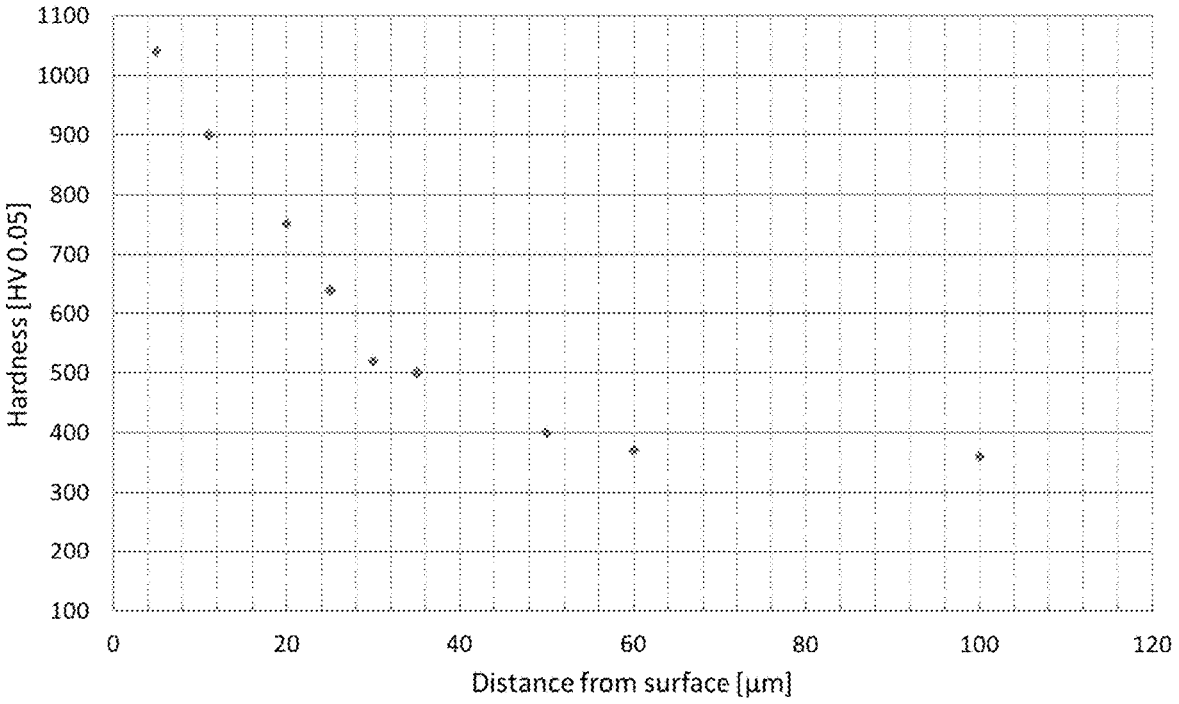
FIG. 2 shows a hardness profile in a cross-section of titanium Grade 5 case hardened according to the first embodiment of the invention.

The sample treated according to the method of the invention was also subjected to a microhardness analysis, and the results are shown in FIG. 2. The Grade 5 titanium had a core hardness of 360 HV (0.05), and the hardness recorded at 11 μm was above 1000. Likewise, a microhardness much above 150% of the core hardness is observed at 20 μm, and a microhardness of about 125% of the core hardness is observed at about 30 μm.

Example 2

Cycles of $O_2$ Supply/Non-supply

Samples of Titanium Grade 5 were treated in a reactive atmosphere according to the invention at a temperature of 750° C. for reactive periods of at least 5 hours following the procedure otherwise outline in Example 1, except that the oxygen supply was paused after 2 hours for a period of 2 hours and then started again. This cycle of oxygen supply for two hours followed by pausing the supply for two hours was repeated for the duration of the treatment.

Figure 3:
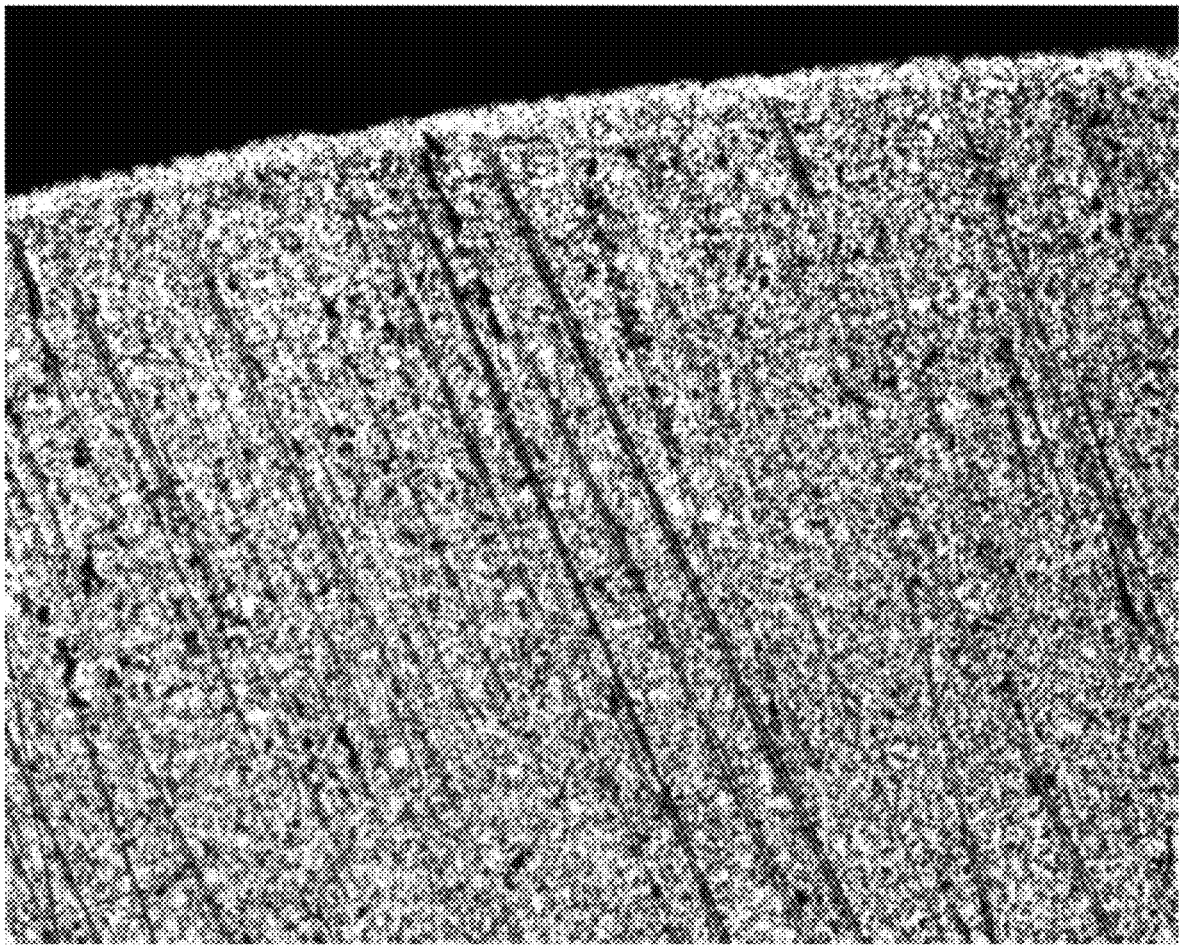
FIG. 3 shows a cross-section of titanium Grade 5 case hardened according to a second embodiment of the invention.
Figure 4:
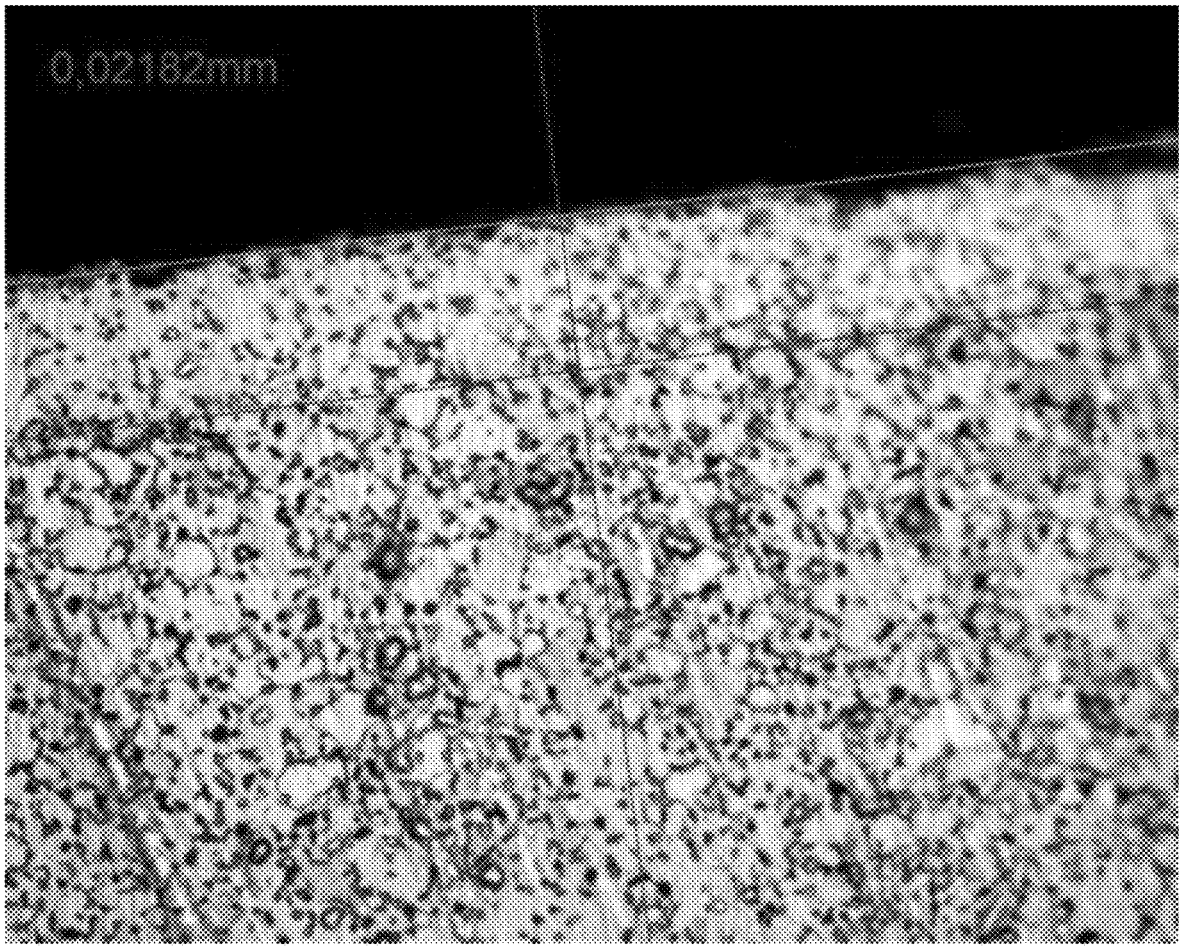
FIG. 4 shows a higher resolution cross-section of titanium Grade 5 case hardened according to the second embodiment of the invention.
Figure 5:
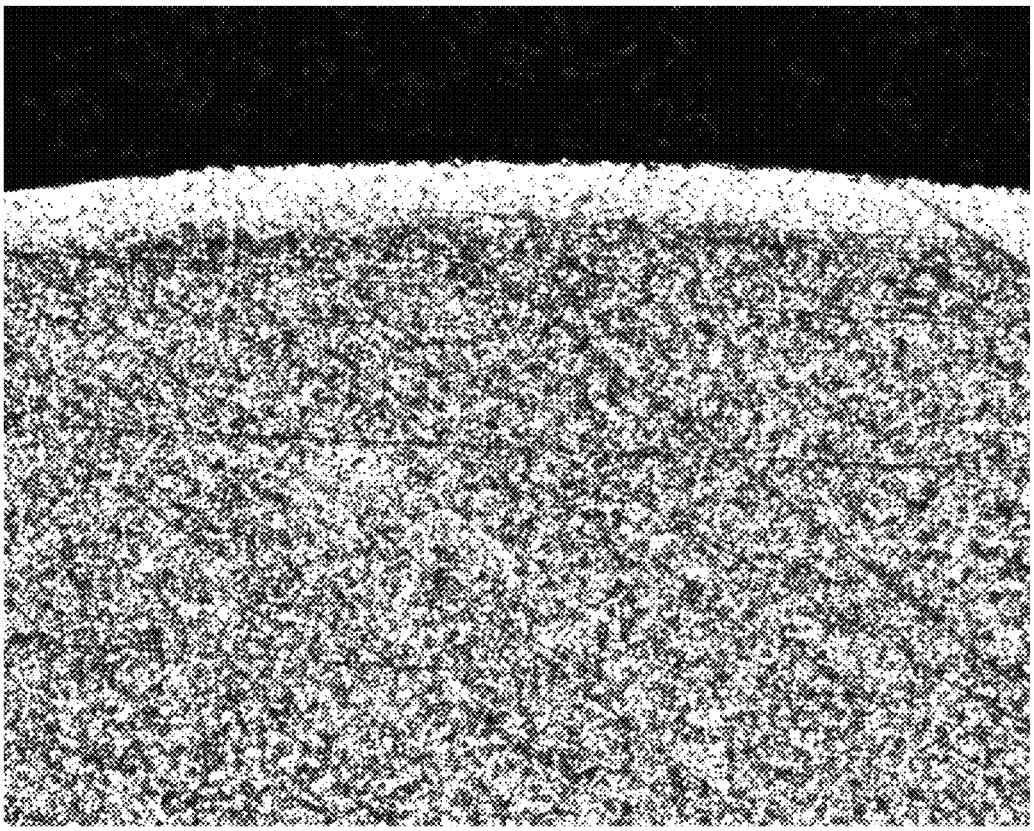
FIG. 5 shows a cross-section of titanium Grade 5 case hardened according to a third embodiment of the invention.
Figure 6:
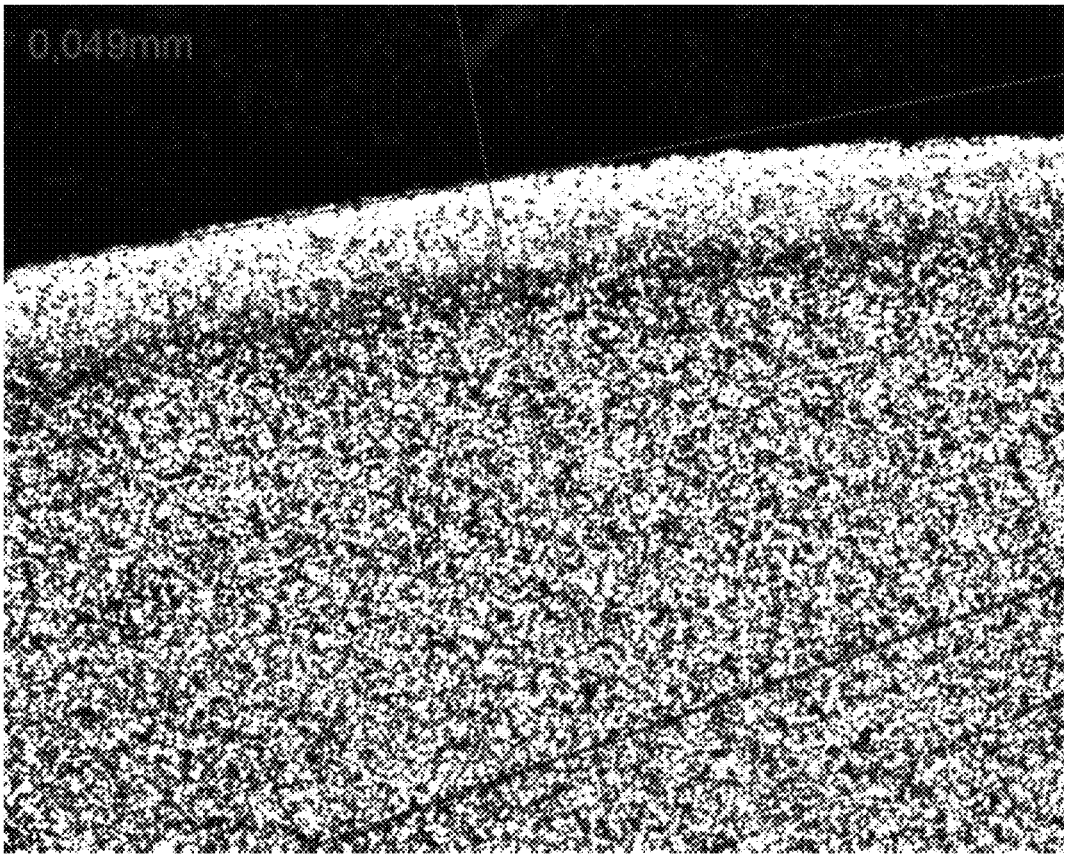
FIG. 6 shows a higher resolution cross-section of titanium Grade 5 case hardened according to the third embodiment of the invention.

Cross-sections of a sample treated for 5 hours are shown in FIG. 3 and FIG. 4, and cross-sections of a sample treated for 30 hours are shown in FIG. 5 and FIG. 6. The cross-section of a sample treated for 30 hours is shown in FIG. 6 at a higher magnification than shown in FIG. 5. Also, in this case, the diffusion layer is clearly discernible and in particular it is evident that no oxide or other compounds have formed with the titanium.

The thicknesses of the diffusion layers obtained after 5 and 30 hours are indicated in FIGS. 4 and 6, respectively.

Example 3

Steady $O_2$ Supply

Samples of Titanium Grade 2 (i.e. pure titanium) were treated in a reactive atmosphere according to the invention at a temperature of 750° C. for a reactive period of 58 hours following the procedure otherwise outlined in Example 1. FIG. 7 shows the hardness profile of a sample treated for 58 hours. It is evident that the microhardness at 5 μm is above 1100 HV, and that the microhardness at a depth of 20 μm is above 900 HV compared to the core hardness of less than 300 HV.

Example 4

Steady $O_2$ Supply

Figure 8A:
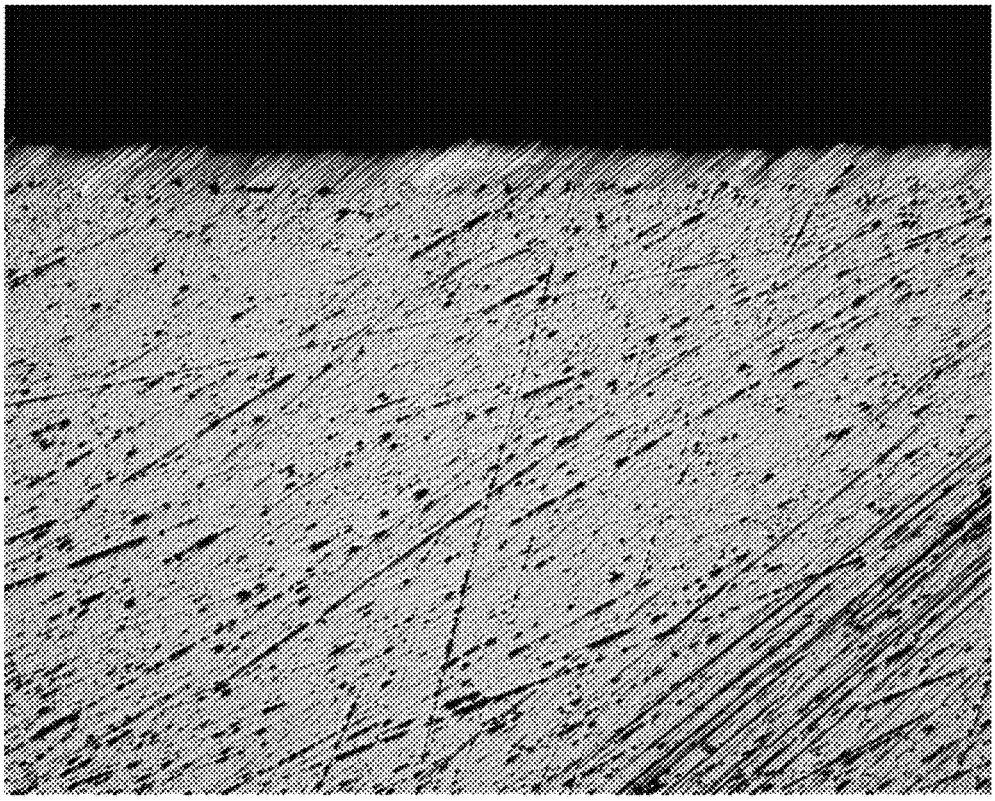
FIGS. 8A and 8B show cross-sections of zirconium case hardened according to the invention.
Figure 8B:
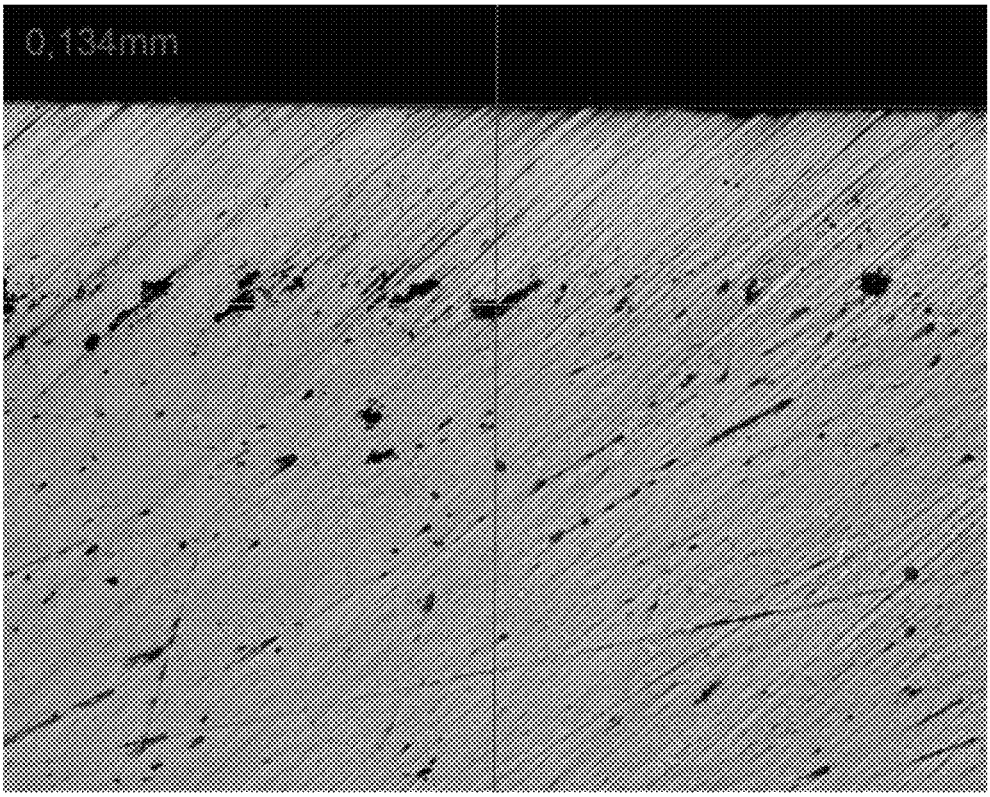
Figure 9:
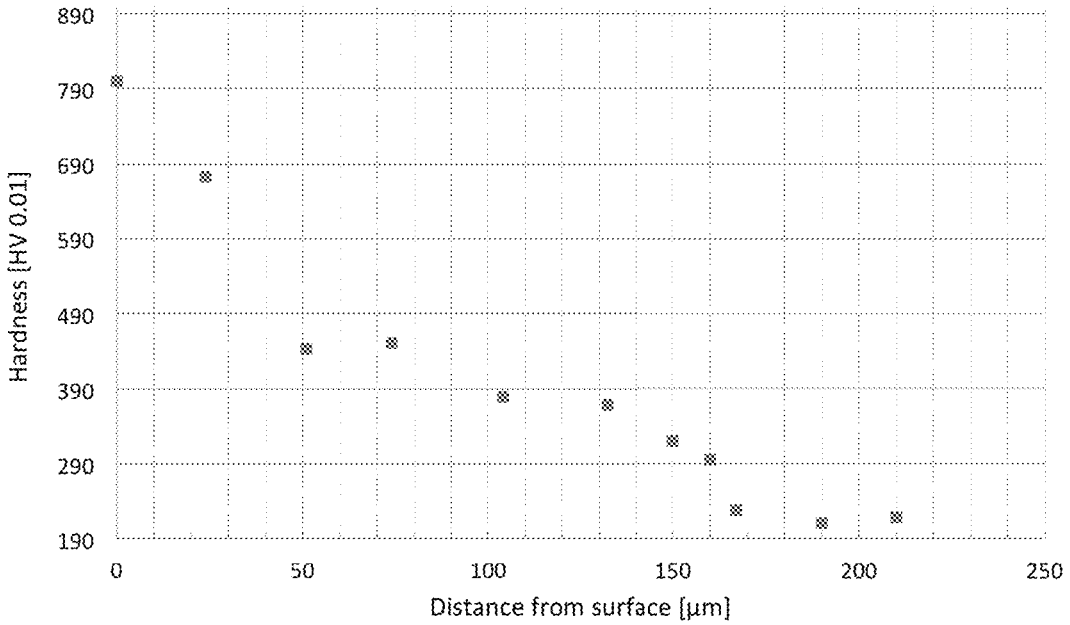
FIG. 9 shows a hardness profile in a cross-section of zirconium case hardened according to the invention.

A sample of zirconium was treated according to the invention at a temperature of 750° C. for 28 hours following the procedure otherwise outlined in Example 1. A cross-section of the treated sample is shown at a low magnification in FIG. 8A and at a higher resolution in FIG. 8B. The diffusion layer is clearly visible at both magnifications, and the thickness of the diffusion layer was recorded as 134 μm from the visual inspection. The hardness profile of the hardened zirconium is shown in FIG. 9. It is evident that the core hardness was about 220 HV, and the hardness at 1 μm depth was above 790 HV. At 20 μm depth the microhardness was above 150% of the core hardness, e.g. at about 690 HV. At a depth of 150 μm the microhardness was above 125% of the core hardness.

Example 5

Graphite Retort

Samples of Titanium Grade 2 (i.e. pure titanium) were treated in a reactive atmosphere according to the invention at a temperature of 750° C. for a reactive period of 15 hours following the procedure otherwise outlined in Example 1, except that the vessel comprised a graphite retort. The presence of carbon in solution in the Grade 2 titanium was subsequently identified.

Figure 10A:
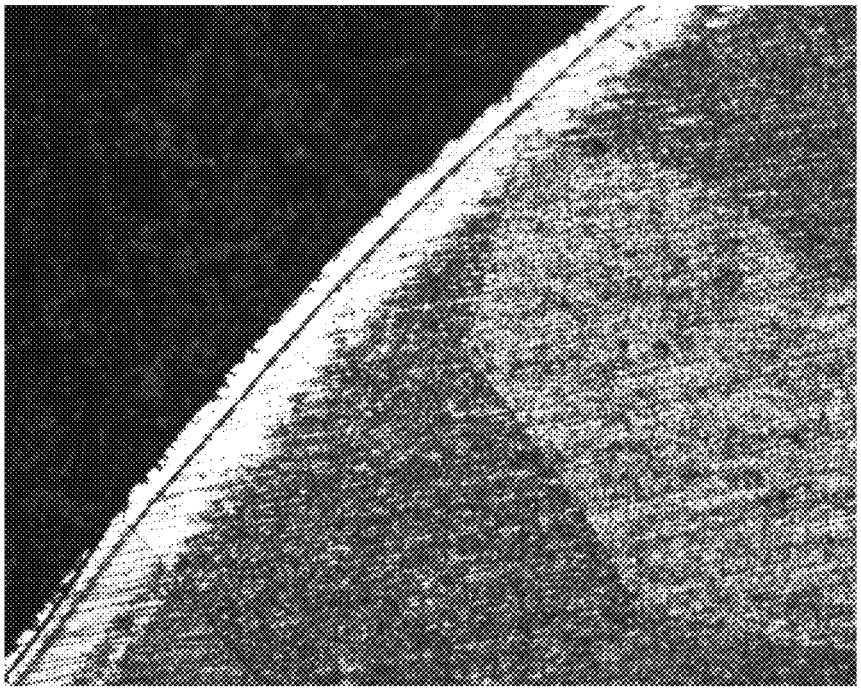
Figure 10B:
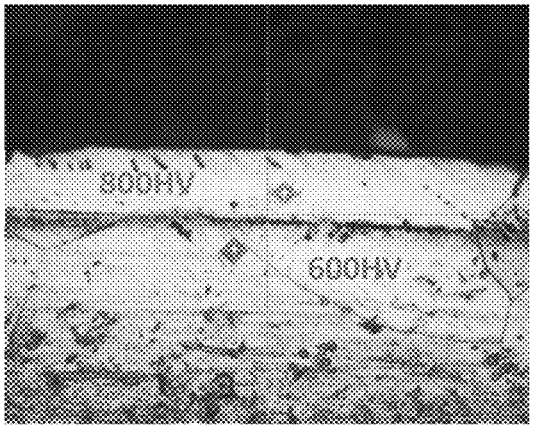
Figure 10C:
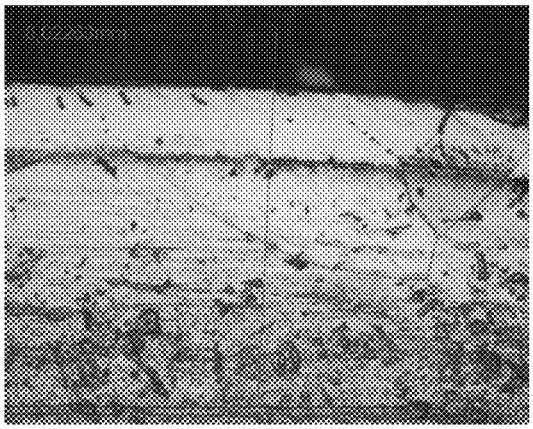
Figure 11:
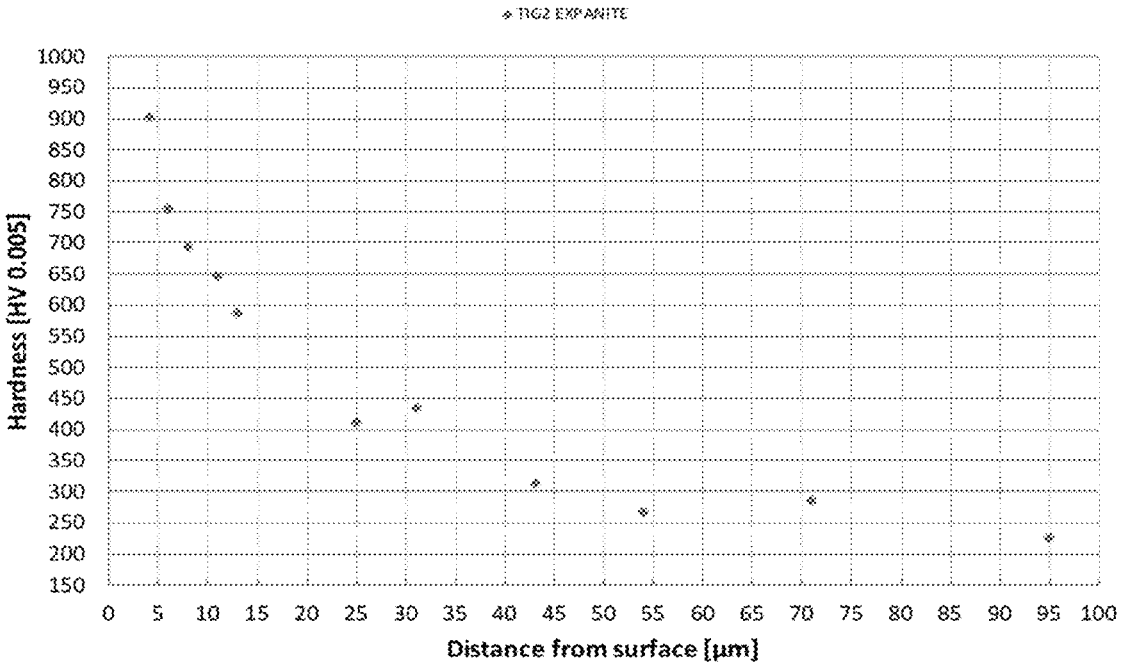
FIG. 11 shows the hardness profile of carbon and oxygen-containing titanium Grade 2 hardened according to the invention.

FIGS. 10A-10C show cross sections of the Titanium Grade 2 obtained under these conditions. The oxygen-carbon double layer can clearly be seen in the hardened zone. The corresponding hardness profile achieved can be seen in FIG. 11. The carbon contribution to the profile can be seen from 22 μm onwards and makes a significant contribution the profile.

The invention claimed is:

1. A method of producing a case hardened workpiece of a Group IV metal, the method comprising the steps of:

placing a workpiece of a Group IV metal in a vessel, creating a low pressure environment in the vessel in which the pressure, $p_{vac}$, is less than or equal to $10^{-5}$ bar, providing oxygen to the vessel to create a reactive atmosphere in the vessel, the reactive atmosphere comprising oxygen at a partial pressure, $p_{O2}$, in a range of $10^{-5}$ bar to 0.01 bar, heating the workpiece to a hardening temperature in a range of 650° C. to 800° C. in the reactive atmosphere or before the reactive atmosphere is created, maintaining the workpiece in the reactive atmosphere at the hardening temperature for a reactive period of at least 5 hours, cooling the workpiece from the hardening temperature to ambient temperature in the reactive atmosphere or in an inert atmosphere.

2. The method of producing a case hardened workpiece of a Group IV metal according to claim 1, a total pressure of the reactive atmosphere being a sum of $p_{vac}$ and $p_{O2}$.

3. The method of producing a case hardened workpiece of a Group IV metal according to claim 1, wherein oxygen is supplied to the vessel for a total duration of the reactive period.

4. The method of producing a case hardened workpiece of a Group IV metal according to claim 1, wherein the reactive period comprises at least one supply period and at least one non-supply period, a supply period being a period of time in which oxygen is added to the vessel and a non-supply period is a period of time in which no further oxygen is added to the vessel.

5. The method of producing a case hardened workpiece of a Group IV metal according to claim 4, wherein the at least one supply period has a duration in the range of 1 minute to 10 minutes and the at least one non-supply period has a duration of from 1 minute to 3 hours.

6. The method of producing a case hardened workpiece of a Group IV metal according to claim 1, wherein the hardening temperature is in the range of 700° C. to 750° C.

7. The method of producing a case hardened workpiece of a Group IV metal according to claim 1, wherein the reactive period has a duration in the range of 5 hours to 75 hours.

8. The method of producing a case hardened workpiece of a Group IV metal according to claim 1, further comprising polishing the workpiece after the step of cooling the workpiece.

9. The method of producing a case hardened workpiece of a Group IV metal according to claim 1, wherein the Group IV metal is selected from the group consisting of titanium and titanium alloys.

10. The method of producing case hardened workpiece of a Group IV metal according to claim 1, wherein the method further comprises the step of core hardening the workpiece after the step of cooling the workpiece.

11. The method of producing a case hardened workpiece of a Group IV metal according to claim 1, wherein the vessel comprises a graphite retort.

12. The method of producing a case hardened workpiece of a Group IV metal according to claim 11, a total pressure of the reactive atmosphere being a sum of pvac, $p_{O2}$, $p_{CO}$ and $p_{CO2}$.

* * * * *